United States Patent [19]

Pinto

[11] 4,146,944

[45] Apr. 3, 1979

[54] CARPET CLEANING MACHINE

[75] Inventor: Louis J. Pinto, Scotch Plains, N.J.

[73] Assignee: General Signal Corporation, Rochester, N.Y.

[21] Appl. No.: 826,013

[22] Filed: Aug. 19, 1977

[51] Int. Cl.[2] ..... A47L 7/00

[52] U.S. Cl. ..... 15/321

[58] Field of Search ..... 15/320, 321, 322

[56] References Cited

U.S. PATENT DOCUMENTS

| | | | |
|---|---|---|---|
| 3,101,505 | 8/1963 | Belicka et al. | 15/320 |
| 3,408,673 | 11/1968 | Oxel | 15/320 X |
| 3,663,985 | 5/1972 | Burgoon | 15/320 X |
| 3,992,747 | 11/1976 | Hufton | 15/321 |
| 4,014,067 | 3/1977 | Bates | 15/320 |

*Primary Examiner*—Christopher K. Moore

*Attorney, Agent, or Firm*—Milton E. Kleinman; George W. Killian

[57] ABSTRACT

A carpet cleaning machine having a scrub brush, independent means for selectively delivering cleaning and rinse solutions, and vacuum means for removing the solutions and entrained dirt. A cleaning head is moved about the carpet on a pair of wheels by an attached operating handle which includes means for controlling the volume and timing of the release of the solutions. The wheels are so located, with respect to the center of gravity of the head, that the scrub brush is normally in contact with the carpet. However, in response to appropriate manipulation of the operating handle, the head is pivoted about the axis of the wheels and the scrub brush is lifted from the carpet and the vacuum nozzle brought in contact with the carpet. A pump is used to deliver rinse solution from a reservoir to the head by a flexible hose and the vacuumed waste is delivered to a remote collection chamber through a flexible hose and a portion of the operating handle. To protect the rinse solution pump, a bypass loop is provided.

11 Claims, 3 Drawing Figures

CARPET CLEANING MACHINE

BACKGROUND OF THE INVENTION

The present invention relates to floor treating and cleaning machines, and more particularly to the type which includes a vacuum or suction and a rotating brush. One common vacuum cleaner which is found in many homes includes a hollow handle to which a floor cleaning attachment is coupled at a lower end and to which a flexible hose is connected at the upper end with the other end of the flexible hose connected to a vacuum source and a dirt collecting compartment. These are frequently referred to as tank-type cleaners. Most cleaners of this general description are suitable for picking up only dry dirt. Other types have been developed for picking up wet solutions carrying entrained dirt. Another type of floor cleaning or treating machine includes a supply of liquid cleaning solution and frequently a rotating brush for scrubbing the floor or floor covering with the cleaning solution. A typical machine of this type is disclosed in the Meyerhoefer U.S. Pat. No. 3,392,885 which is assigned to the Regina Corporation which in turn is a unit of the corporation to which the present invention is assigned. A variety of machines have been developed which combine the wet cleaning action and the vacuum pickup. A representative assortment are disclosed in U.S. Pat. Nos. 3,550,181, 3,624,668, 3,711,891, and 4,014,067.

U.S. Pat. No. 3,550,181 to Donlan et al. discloses a structure wherein the cleaning solution and entrained dirt vacuumed from the floor is deposited in a recovery tank which comprises an integral part of the structure.

U.S. Pat. No. 3,624,668 to Krause discloses a structure wherein the tank for collecting the cleaning solution and entrained dirt is remote from the cleaning and vacuuming head and is coupled thereto by means of a flexible hose.

U.S. Pat. No. 3,711,891 to Conway discloses another version of a head including means for dispensing the liquid cleaning solution and for picking up the cleaning solution and entrained dirt and transporting it via a flexible hose to a remote collection tank.

U.S. Pat. No. 4,014,067 to Bates discloses a structure which provides a cleaning solution, scrubbing action, rinse solution and vacuum action. This machine is designed for a one pass operation. That is, it is moved in one direction only while in operation. The ordinary household user of carpet cleaning equipment is used to a reciprocating or forward and backward motion of the equipment.

Most systems which teach a remote collection tank disclose a flexible hose which is coupled from the cleaning head to the collection tank and which may lay on the floor between the cleaning head the the collection tank. Because the cleaning head is normally moved in a reciprocal pattern and back and forth over a given area, it has been found that frequently the vacuum hose is in the way. Not only is the vacuum hose in the way of the cleaning head, but frequently the operator steps on the hose and/or is tripped by it.

SUMMARY OF THE INVENTION

The present invention provides for a new and more convenient floor and/or floor covering cleaning machine which is designed to provide more effective and efficient cleaning in a household and permits manipulation with which the typical householder is familiar.

More specifically, the machine may be used in the customary reciprocal, or back and forth, motion. All controls, except for the on/off electrical switch, are arranged for hand operation at the gripping point. The suction hose is kept off the floor in the vicinity of the cleaning head, thereby eliminating inconvenience and the possibility of tripping the operator. Thee last named benefit is accomplished by using a portion of the operating handle as the vacuum path. The cleaning solution and the rinse solution have independent valve controls which may be manipulated according to the desires of the operator. Scrubbing action is provided in response to the customary forward and backward movement of the operating handle; and vacuuming of the floor covering to remove the cleaning solution, suds and rinse solution is accomplished by the same motion after a slight pivoting motion of the operating handle which rocks the head to lift the brushes and lower the vacuum channel.

A bypass is provided around the rinse solution pump in order to permit use of a smaller and more economical pump which will not overheat during the period of time that the valve is not opened to allow application of rinse solution to the floor covering.

A convenient and novel aspect of the structure resides in the tank which provides the source of cleaning solution and the waste return. The vacuum motor and the pump motor are mounted on the lid, thereby providing an assembly which is more economical to manufacture and maintain.

It is an object of this invention to provide a new and improved floor, or floor covering, cleaning machine.

It is a more specific object of the invention to provide a new and improved floor covering cleaning machine which is more convenient to use and manipulate.

It is another object of the invention to provide a new and improved floor cover cleaning machine which keeps the vacuum hose from the area being treated.

It is a more specific object of the invention to provide a structure wherein a portion of the operating handle serves as the vacuum, or suction, route.

It is another object of the invention to provide a structure which may be used to scrub the area being treated and to vacuum the area to remove the cleaning and rinse solution together with the entrained dirt.

It is another object of the invention to provide a system which avoids the overheating of the rinse solution pump.

It is another object of the invention to provide a structure which may be used sequentially and selectively to scrub, rinse, and vacuum.

It is another object of the invention to provide a machine which may be shifted from scrubbing action to vacuum and/or rinse action in response to a tilting of the cleaning head.

BRIEF DESCRIPTION OF THE DRAWING

The invention will be more readily comprehended when reference is made to the following specification, taken together with the drawing which comprises three figures and wherein like numbers denote like parts in all figures.

DESCRIPTION OF THE PREFERRED EMBODIMENT

Figures 1, 2, 3:
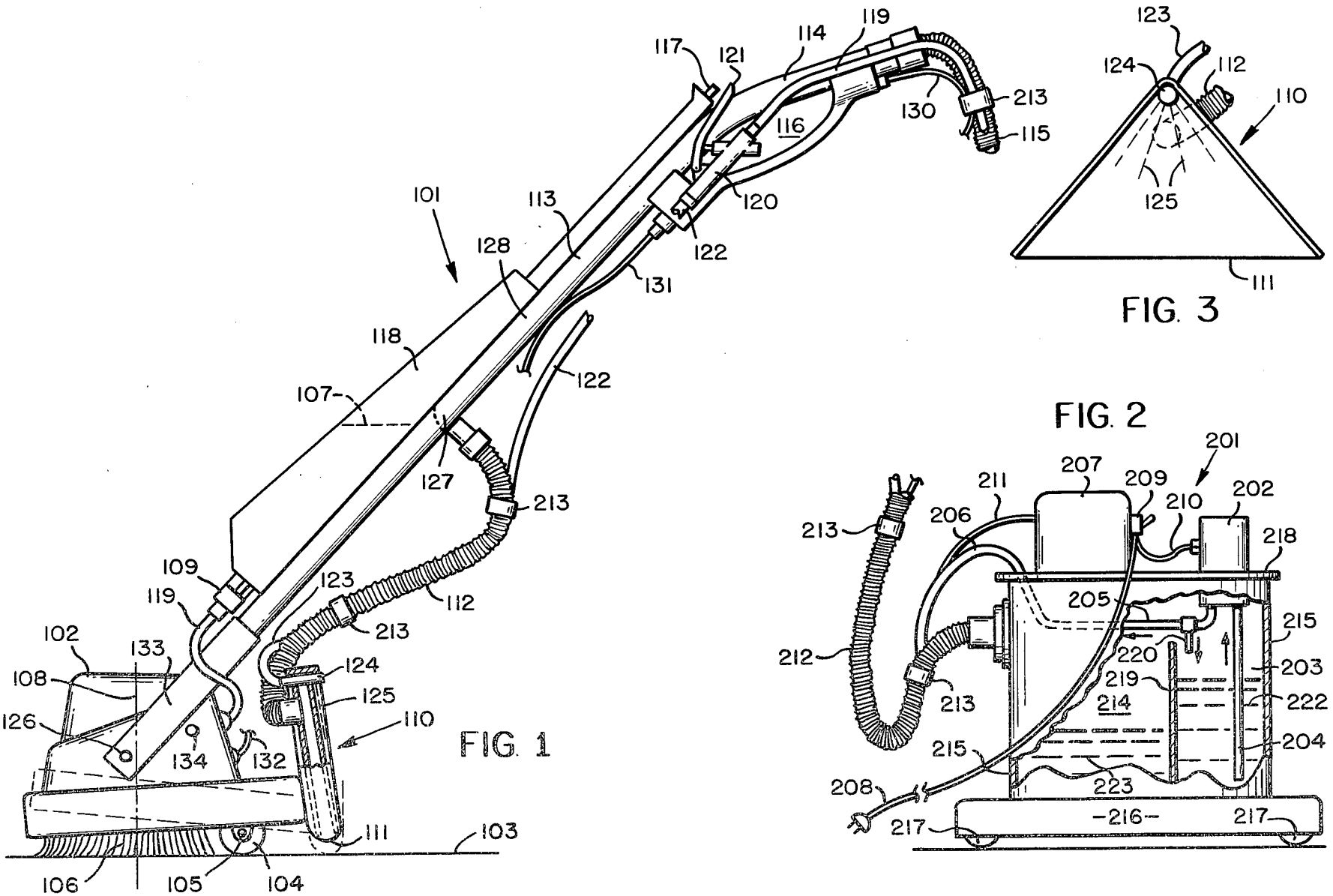
FIG. 1 illustrates an overall side view of the shampoo machine, vacuum nozzle, operating handle, and controls.
FIG. 2 is a partially cut away view illustrating the reservoir for the rinse solution and the tank for the waste return together with associated parts and controls.
FIG. 3 comprises a rear view of the vacuum and rinse portion of the cleaning head.

While the floor treating and cleaning machine of the present invention may be used for cleaning floors with a wide variety of surface coverings, it is anticipated that it will be used primarily for cleaning rugs and carpets, or the like, which may be fabricated of any of the conventional materials. As will be seen as the description proceeds, the present structure provides means for applying a cleaning solution which may include appropriate soaps, detergents, and/or chemicals mixed with water, or other appropriate fluids, to the surface to be cleaned. Concomitantly, a rotating brush works the cleaning solution into the carpet to create a foam and float the embedded dirt to the upper surface, all in the manner which is well known and established in the carpet cleaning art. After the appropriate shampooing and scrubbing action, a rinse spray is applied to dilute the foam and rinse the carpet. Thereafter, a vacuum nozzle is passed over the carpet to suck up the waste solution comprising the cleaning solution and/or, the shampoo, the rinse solution and entrained dirt, all of which is passed through a vacuum hose to a waste receptacle. All controls relating to the applying of the cleaning solution, the rinse solution and the selection between the scrubbing and vacuuming action are controlled by hand from the vicinity where the handle is held for control and manipulation.

Considering now more specifically the carpet cleaning machine, it will be seen to be designated generally by the number 101. The cleaning machine 101 includes a cleaning head 102 which is supported on the floor or upper carpet surface 103 on a pair of wheels 104 supported on opposite ends of an axle 105. The axle 105 and wheels 104 are so positioned on the head 102 that, as viewed in FIG. 1, the center of gravity 108 of the head 102 is to the left of the axle 105. Accordingly, the head 102 will pivot about the axle 105 and cause the brush 106 to be in contact with the carpet surface 103. In the illustrated example, the brush 106 is rotated about a vertical axis, as viewed in FIG. 1, by a motor included in the head 102, all in the manner which is customary in the trade. In fact, this portion of the machine 101 may be fabricated to closely resemble the machine disclosed in the Meyerhoefer U.S. Pat. No. 3,392,885 which issued July 16, 1968, and is assigned to the same corporation as the present invention. While the machine 101 could be made with a single brush 106, it has been found that it is more convenient to operate and control a machine which has two side by side brushes.

Rigidly coupled to the head 102 is a vacuum or suction head indicated generally as 110 and which has a horizontal nozzle opening 111 which, during scrubbing action, is suspended above the carpet surface 103. The nozzle or channel vacuum inlet 111 communicates with a vacuum source through hose 112 which communicates with the nozzle 111 at one end and couples to a hollow section 128 of the operating handle 113 at an intermediate point 127. The vacuum connection continues through the upper end 114 of the handle 113 to another hose portion 115 and thence through a hose of appropriate length to the hose portion 212 which connects to the reservoir and waste tank indicated generally as 201.

An operator may selectively and guidingly manipulate the machine 101 by gripping the operating handle 113 at the upper handle end 114 and placing the fingers through the grip opening 116. In this position, the thumb of the operator's hand will be in a convenient position for actuating the thumb piece 117 which controls a valve 109 to release cleaning solution 107 from the cleaning solution supply tank 118. This mechanism may function in the manner more specifically described in the above mentioned Meyerhoefer patent. In response to the actuation of the thumb piece 117, the cleaning solution 107 within the cleaning solution tank 118 will pass through the tubing 119 and be applied to the brushes 106 and the carpet 103, all in the manner described more fully in the cited Meyerhoefer patent.

As the machine 101 is moved back and forth in reciprocal motion on the carpet surface 103, the brushes 106 will serve to foam the cleaning solution 107 applied to the carpet and scrub the rug 103. When the operator believes that sufficient cleaning action has taken place, rinse solution 222 which may comprise ordinary water and/or other appropriate chemicals, may be pumped by pump 202 from the reservoir 203 through tubing 204 and the pump 202 through tubing 205 and connecting hose 206 which is either coupled to the hose 212 or manufactured as an integral part thereof and connects to the hose 119. When it is desired to release rinse solution 222, the operator will open valve 120 by depressing handle 121 and the rinse solution 222 will be passed through hose 122 to lower hose portion 123 and jet nozzle 124 which directs a spray 125 to the carpet surface 103.

It will be understood that the motor in the head 102 for rotating the brushes 106 is electrically driven, as is the pump 202 and the vacuum motor 207. Electrical energy to these motors is provided by plugging in the cord 208 and operating the switch 209. Wire 210 provides power to the pump 202, and wire 211 follows the hose 212 which is a continuation of the hose 115 and may be seen as wire 130 in FIG. 1. The wire continues and is partially obscured in FIG. 1, but a portion may be seen at 131 and it extends to wire 132 to provide electrical power to the motor in the head 102. As illustrated, the single switch 209 connects power to the motor for the scrubber brushes 106, the vacuum motor 207, and the pump motor 202. If desired, a separate switch (not shown) could be provided near the grip opening 116 to permit separate control of the motor for rotating the brushes 106 and/or for control of the vacuum motor 207 and/or the pump 202. While the drawing illustrates the wire 211 as being coupled to the hose 212 by a method such as a tie 213, it should be understood that other techniques might be used which makes the wiring integral with the hose 212 by some means which might take the form shown in U.S. Pat. No. 3,300,571 to Downey et al. In a similar manner, the hose 206 could be made an integral part with the hose 212. However, the assembly and function are easier to visualize as illustrated.

It has been described above how the machine 101 may be used for dispensing cleaning solution 107 and scrubbing the carpet surface 103 with the brush 106. When the operator believes that there has been sufficient cleaning action, a downward or pivoting motion may be applied at the grip opening 116 to cause the operating handle 113 to pivot about point 126 until the yoke 133 bears on the stop 134. Continued angular motion of the grip opening 116 and the operating handle 113 will cause the head 102 to pivot slightly about the wheels 104 or the axle 105, thereby raising the brush 106 from the carpet surface 103 and lowering the vacuum head 110 and placing the nozzle 111 in contact with the carpet 103. By manipulating the machine 101 in a to and fro reciprocating motion and actuating the handle 121 to open the valve 120, rinse solution 222 may be pumped from reservoir 203 by pump 202 and dispersed by jet nozzle 124 onto the scrubbed surface of the carpet 103. When sufficient rinse solution 222 has been applied, the handle 121 may be released and the vacuum head 110 will pick up the cleaning solution, rinse solution, and entrained dirt and transport it through hose 112 and the hollow portion 128 of the handle 113 and through the upper hose 115 to the continuation hose 212 and the waste return tank 214. Depending upon the soil in the carpet and the operator's judgment, the operator may shift back and forth between a scrubbing action, a rinsing action, and a vacuum action until the carpet 103 is properly cleaned.

The reservoir and waste tank assembly 201 may include an outer support shell 215, a base 216, and wheels 217. Supported by the shell 215 is a cover 218 which supports the pump 202 and the vacuum motor 207. Although not illustrated, it should be understood that convenient disconnect means are provided in hose 206 and wire 211 so that they may be disconnected from the subassemblies supported on the cover 218. This will permit easy removal of the cover 218 and the subassemblies thereon to permit maintenance and/or repair as well as easy access to the reservoir 203 and the waste return tank 214. Any of a variety of means may be provided for emptying the reservoir 203 and the waste return tank 214. For example, drain valves (not shown) may be included at a low point in the shell 215, or siphoning techniques may be used, or containers may be used which are lifted from the shell 215 and individually dumped. A divider 219 keeps the contents of the reservoir 203 and the waste return 233 from mixing. The waste return tank 214 is normally somewhat bigger than the reservoir 203 as the waste tank may include suds, used cleaning solution 107, used rinse solution 222, and entrained dirt, all indicated as 223. If desired, the rinse solution in the reservoir 203 may be heated by an electric heating element.

In normal operation, there is a sufficient length of hose between hose 212 and hose 115 to permit operation and manipulation of the machine 101 without more than occasional movement of the reservoir and waste tank assmebly 201.

Connected to pump 202 is a piece of tubing 204 through which rinse solution 222 is pumped from the reservoir 203 and passed to the machine 101 through tubing 205 and hose 206, all in the manner previously set forth. However, those familiar with typical pumps which might be employed as pump 202 will recognize that typical pumps will overheat if fluid is not being passed therethrough. Accordingly, if electrical energy is provided to pump 202 while the valve 120 is closed, no solution would be passed through the pump 202 and the pump would overheat. One method of solving this problem would be to provide special wiring which actuates pump 202 in response to the actuation of the handle 121. This adds expense, inconvenience, and maintenance problems. Another solution would be to provide a special pump 202 which is designed so that it will not overheat under these conditions. However, such a pump would cost considerably more. Accordingly, a fluid bypass system has been devised. Connected to tubing 205 by a T-connection is tube 220. Thus, when valve 120 is closed, the pump 202 will pump rinse solution 222 from the reservoir 203 upward through tubing 204 and it will be returned to the reservoir through tubing 220. The tubing 220 is considerably smaller than the tubing 205 and/or includes flow control means to restrict the flow to about 10% to 20% of the possible flow in hose 206. By providing the bypass system, including tubing 220, an economical pump 202 may be used and will not overheat as fluid is being passed through it at all times, even when the valve 120 is closed. The tubing 220 could be extended to near the bottom of the reservoir 203. However, by using a short piece of tubing 220, the fluid 222 returned to the reservoir 203 will make a splashing noise, thereby providing the operator with an audible indication that there is a supply of fluid 222 in the reservoir 203. When this noise stops, indicating that the reservoir 203 is empty, the operator should shut off the machine 101 by actuating switch 209 and replenish the rinse solution 222 in the reservoir 203. The bypass system also provides circulation of the rinse solution 222 to assure a good mixture if special additives are used in the rinse solution 222.

It should be understood that in accordance with standard practice and good engineering design, the cover 218 forms a good seal with the shell 215 and would ordinarily be coupled thereto by some simple and convenient quick release mechansim. The shell 215 and the base 216 may or may not constitute and integral assembly. The jet nozzle 124 may include an adjustment for adjusting the character of the spray 125 and/or may include provision for interchangeable jet nozzles 124. If desired, a level sensitive switch could be provided in the head 102 to turn off the motor which rotates the brush 106 when the handle 113 is tilted to raise the brush 106 and lower the vacuum head 110. The same switch could be made to turn on the vacuum motor 207. However, in the normal assembly, it is anticipated that both motors and the pump will be running at all times. Other modifications may be made to make a more economical and/or convenient operation.

While there has been shown and described what is considered at the present to be a preferred embodiment of the invention, modifications thereto will readily occur to those skilled in the related arts. For example, the scrub brush could be made to rotate about a horizontal axis instead of a vertical axis. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. A floor covering cleaning machine for scrubbing, rinsing, and vacuuming a floor covering and comprising in combination:

a. first and second liquid sources and a vacuum source;

b. a head coupled to said first and second liquid sources and said vacuum source and selectively and guidingly movable on a pair of rollers over the floor covering to be cleaned;

c. said head including a motor driven scrub brush forward of said pair of rollers for scrubbing the floor covering;

d. said head further including a channel vacuum inlet rearward of said pair of rollers and coupled to said vacuum source, for removing liquids and entrained dirt from the floor covering when positioned in appropriate proximity to the floor covering;

e. first means coupled between said first liquid source and said head for selectively delivering controlled amounts of said first liquid to the floor covering forward of said pair of rollers;

f. second means coupled between said second liquid source and said head for selectively delivering controlled amounts of said second liquid to the floor covering rearward of said pair of rollers;

g. said pair of rollers coupled to said head rearward of the center of gravity of said head whereby, in the absence of other controlling forces, said head tends to pivot about said rollers, in response to the force of gravity, to maintain said scrub brush in contact with the floor covering; and h. an operating handle coupled to said head for guiding said head and for selectively applying a force to pivot said head about said rollers and lift said scrub brush from contact with the floor covering and to simultaneously lower said vacuum inlet whereby the scrubbing of the floor covering is interrupted and said vacuum inlet is positioned proximate to the floor covering for the removal of liquids and dirt from the floor covering.

2. The combination as set forth in claim 1, wherein said first means includes valve control means for controlling delivery of said first liquid from said first source to the floor covering.

3. The combination as set forth in claim 2, wherein said valve control means is mounted on said operating handle.

4. The combination as set forth in claim 3, wherein said operating handle includes a hand grip portion and said valve control means is conveniently situated on said operating handle for selective actuation.

5. The combination as set forth in claim 4, wherein said operating handle is pivotally coupled to said head and said head includes stop means for limiting the pivoting of said operating handle with respect to said head whereby continued pivoting of said operating handle results in the pivoting of said head about said rollers.

6. The combination as set forth in claim 1, wherein said second means includes second valve control means and pump means for controlling delivery of said second liquid from said second source to the floor covering.

7. The combination as set forth in claim 6, wherein said second valve control means is mounted on said operating handle.

8. The combination as set forth in claim 7, wherein said operating handle includes a hand grip portion and said second valve means is conveniently situated on said operating handle for selective actuation.

9. The combination as set forth in claim 8, wherein said operating handle is pivotally coupled to said head and said head includes stop means for limiting the pivoting of said operating handle with respect to said head whereby continued pivoting of said operating handle results in the pivoting of said head about said rollers.

10. The combination as set forth in claim 1, wherein said coupling between said vacuum source and said head comprises a first flexible hose coupled between said vacuum source and said operating handle at a portion thereof remote from said head.

11. The combination as set forth in claim 10, and including a second flexible hose coupled between said head and an intermediate section of said operating handle and communicating with said first flexible hose through a hollow portion of said operating handle.

* * * * *